US005992443A

United States Patent [19]

Rodriguez

[11] Patent Number: 5,992,443

[45] Date of Patent: Nov. 30, 1999

[54] VALVE SYSTEM

[76] Inventor: Osberto M. Rodriguez, 6 Wyman St., Jamaica Plain, Mass. 02130

[21] Appl. No.: 09/116,914

[22] Filed: Jul. 17, 1998

[51] Int. Cl.[6] ..... F16K 31/04; F16K 17/00; H01H 29/06; F22B 37/44

[52] U.S. Cl. ..... 137/312; 122/504.2; 122/507; 137/392; 200/61.04; 307/118; 361/178

[58] Field of Search ..... 122/504, 504.2, 122/507; 137/312, 392, 446; 222/108; 200/61.04, 61.05; 307/118; 340/604, 605; 361/178; 251/250

[56] References Cited

U.S. PATENT DOCUMENTS

| | | | |
|---|---|---|---|
| 3,069,671 | 12/1962 | Taylor | 137/312 |
| 4,572,113 | 2/1986 | Baughman | 122/507 |
| 4,805,662 | 2/1989 | Moody | 137/312 |
| 4,909,274 | 3/1990 | Rodriguez | 137/312 |
| 4,944,253 | 7/1990 | Bellofatto | 122/507 |
| 5,029,605 | 7/1991 | Dowling et al. | 137/312 |
| 5,188,143 | 2/1993 | Krebs | 137/312 |

*Primary Examiner*—George L. Walton
*Attorney, Agent, or Firm*—William Nitkin

[57] ABSTRACT

A valve system for use in conjunction with a hot water heater where the water line to the hot water heater passes through the valve system which, when a leak is detected by an electrical sensor, causes a motor to drive a gear which moves a gear rack laterally to pull a rod attached to a gate which gate moves over a valve outlet to block further flow of water to the hot water heater.

4 Claims, 1 Drawing Sheet

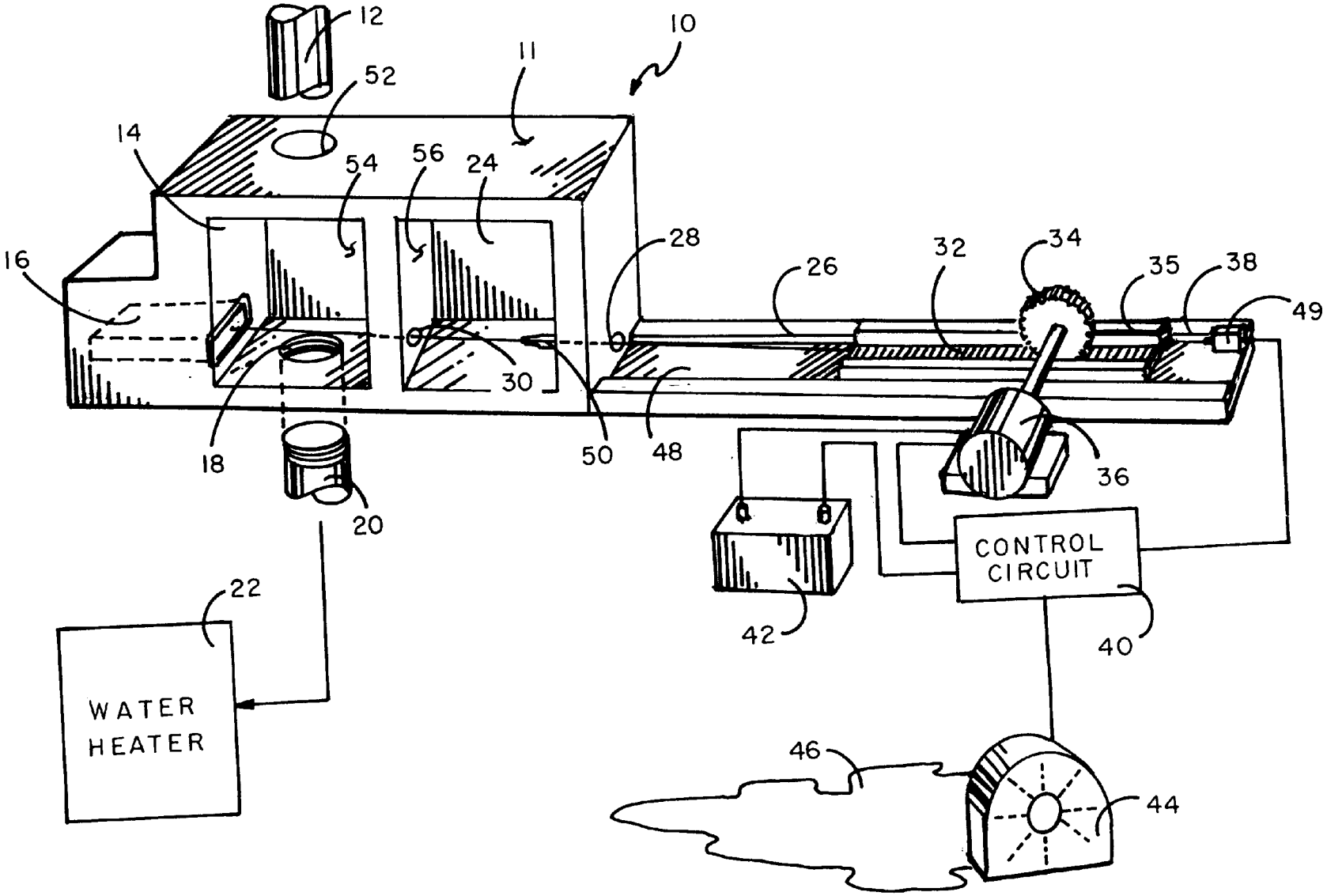
CONTROL CIRCUIT
WATER HEATER
10
11
12
14
16
18
20
22
24
26
28
30
32
34
35
36
38
40
42
44
46
48
49
50
52
54
56

VALVE SYSTEM

BACKGROUND OF THE INVENTION

Field of the Invention

The system of this invention resides in the area of valves and more particularly relates to a shutoff valve system for use with a hot water heater.

Description of the Prior Art

Hot water heaters in common domestic use receive water through a water line. Many hot water heaters are designed such that if the casing of the hot water heater rusts through or otherwise springs a leak, water to the water heater continues to flow through the water line, flooding the area in which the hot water heater is located. In order to prevent such flooding and resulting damage, Osmani A. Rodriguez developed and patented a Valve Apparatus, U.S. Pat. No. 4,909,274 which caused the flood water to raise a float assembly which action mechanically rotated a gear which closed a valve to shut off the water going to the water heater so that damage from such flooding would be limited or stopped. This device helps to provide security and peace of mind that even with a water heater leak, the damage will be minimal or nonexistent.

SUMMARY OF THE INVENTION

The system disclosed herein is an improvement over the aforementioned invention for a Valve Apparatus of Osmani A. Rodriguez. The system disclosed herein utilizes a valve housing having a chamber defined therein, such chamber having a valve inlet and a valve outlet through which water directed to the water heater flows. When water is detected by an electrical water sensor located on the floor near the water heater, it sends a signal to control circuitry which turns on a motor which rotates a gear which moves a gear rack which pulls a rod laterally which in turn pulls a gate to block the valve outlet, thereby stopping water from entering the water heater.

BRIEF DESCRIPTION OF THE DRAWING

The FIGURE illustrates a perspective view of the valve system of this invention.

DESCRIPTION OF THE PREFERRED EMBODIMENT(S)

The FIGURE illustrates a perspective view of the valve system of this invention. Valve housing 11 is disposed on the water line to water heater 22 which heater is depicted in block format. The water line has inlet pipe 12 which directs water through valve opening 52 defined in the top of valve housing 11 wherein the water enters into first chamber 14 which can have a plastic or glass window thereover, as described further below, and exits through valve outlet 18 into outlet pipe 20 which delivers the water to water heater 22. In its open mode, valve system 10 of this invention allows water to pass therethrough. However, when water escapes out of water heater 22, such as by leaking to form a water puddle 46 on the floor, a water detector such as electronic water sensor 44 of a type that is well known, for example, Zircon Water Detector made by Zircon Corporation of Campbell, Calif. 95008, not only can sound an alarm, if desired, but also sends a signal to control circuit 40 which then directs power from a power source such as battery 42 to a motor 36. Motor 36, when activated, rotates gear 34 which drives gear rack 32 away from valve housing 11. Gear rack 32 moves laterally within a channel 35 formed in base support 38. Gear rack 32 can be disposed in channel 35 or placed in any other equivalent configuration such as would allow its movement laterally to pull rod 26 along with it as it moves away from valve housing 11. Rod 26 extends through first aperture 28, through second chamber 24, through second aperture 30, through first chamber 14, to its attachment to gate 16. Gate 16 in a preferred embodiment can be a rectangular piece of metal but other shapes can be used as long as gate 16 can fully cover valve outlet 18. Gate 16, when pulled to the right by the action of gear rack 32 pulling rod 26, covers valve outlet 18 which action effectively blocks the flow of water out of valve outlet 18 to water heater 22. When gear rack 32 comes in contact with switch 48, it activates switch 48 which sends a signal back to control circuit 40 to shut off current to motor 36 so that its operation ceases. When operation of motor 36 ceases, valve outlet 18 is blocked by gate 16 and water no longer flows to water heater 22. Rod 26 passes through close-fitting first and second apertures 28 and 30 and can also pass through a bellows washer 50 to prevent leakage from second chamber 24. Second chamber 24, should water accumulate therein, utilizes bellows washer 50 to prevent any leakage of water therefrom. Once the water heater has been repaired or replaced and is no longer leaking, one can then reset gear rack 32 back to its original starting position with rod 26 moved to the left and gate 16 positioned at its starting position beyond valve outlet 18 so that valve outlet 18 is no longer blocked and water can freely pass from inlet pipe 12 through first chamber 14 to outlet pipe 20 and then to water heater 22.

The use of a water detector such as electronic water sensor 44 is an improvement over the float and mechanical systems of the prior art as it quickly senses the presence of water and directs a signal to an electric-powered drive system which shuts off the water flow to the water heater. Further, the invention herein utilizes much less material in its construction and is of lower cost to product than prior art systems. The valve system of this invention can be independent of house current by utilizing battery 42 although in some embodiments a combination of house current and a back-up battery can be utilized. Water sensor 44 can also be powered by a battery, house current or a combination thereof. First and second viewing apertures 54 and 56 can be provided, respectively, in first and second chambers 14 and 24 and covered by a sheet of heavy clear plastic or glass which is transparent so that the water level in the chambers can be seen. Such plastic sheet or glass is not illustrated in the Figure but can be attached by well-known means, such as screws with a gasket washer thereunder, to valve system 10. The control circuit, motor, gear, and gear rack structure can all be covered by a housing, not shown.

Although the present invention has been described with reference to particular embodiments, it will be apparent to those skilled in the art that variations and modifications can be substituted therefor without departing from the principles and spirit of the invention.

I claim:

1. A valve system for use in conjunction with a water heater attached to a water pipe, comprising:

a valve housing;

a first chamber having a first end, a second end, a top and a bottom defined in said valve housing;

a valve inlet defined in said top of said first chamber, said valve inlet receiving said water pipe;

a valve outlet defined in the bottom of said first chamber;

an interconnecting pipe connecting said valve outlet to said water heater;

a gate member disposed in said first chamber, said gate member in an open mode disposed offset from said valve outlet towards said first end of said first chamber;

a rod member having a first end and a second end, said first end attached to said gate member;

an electric water sensor having means to signal the presence of water;

means to move said rod member laterally upon the sensing of water by said water sensor, such movement pulling said gate member over said valve outlet to prevent water flow to said water heater, said means to move said rod member including:

a control circuit receiving signals from said water sensor;

a power source;

a motor interconnected to said power source through said control circuit;

a gear rotated by said motor;

a base;

a channel defined in said base, said channel having an end; and a gear rack disposed within said channel, said gear rack having an end, said gear rack engaged by said gear; said gear rack attached to said second end of said rod member, said gear rack, when said control circuit directs power from said power source to said motor upon the sensing of water by said water sensor, rotating said gear to move said gear rack laterally within said channel and to pull said gate member toward said second end of said first chamber to a closed mode disposed over said valve outlet.

2. The system of claim 1 further including a switch positioned on said base at said end of said channel, said switch positioned to be activated by said gear rack when said gear rack reaches said end of said channel, said switch interconnected to said control circuit to cause said control circuit to shut off said motor when said switch is activated by said gear rack.

3. The system of claim 2 wherein said power source is a battery.

4. The system of claim 3 wherein said power source is house current.

* * * * *